US005549372A

United States Patent [19]

Lewis

[11] Patent Number: 5,549,372

[45] Date of Patent: Aug. 27, 1996

[54] SKILL CRANE CABINET

[76] Inventor: Michael W. Lewis, 28132 Via Rueda, San Juan Capistrano, Calif. 92675

[21] Appl. No.: 402,012

[22] Filed: Mar. 10, 1995

[51] Int. Cl.[6] ..... A47F 3/026

[52] U.S. Cl. ..... 312/114; 312/265.1; 312/257.1; 312/140; 312/265.2; 312/265.4; 312/265.6; 312/265.5; 312/138.1; 312/124; 273/448

[58] Field of Search ..... 312/114, 140, 312/257.1, 265.5, 265.6, 124, 265.1, 265.2, 265.3, 265.4

[56] References Cited

U.S. PATENT DOCUMENTS

| | | | |
|---|---|---|---|
| 1,846,485 | 2/1932 | Hart | 312/114 |
| 2,475,079 | 7/1949 | Clouse et al. | 312/114 |
| 2,600,849 | 6/1952 | Collins et al. | 221/210 X |
| 3,150,903 | 9/1964 | Chapman et al. | 312/138 |
| 3,346,310 | 10/1967 | Diack | 312/114 X |
| 3,525,560 | 8/1970 | Gasner . | |
| 3,697,363 | 10/1972 | Martinez . | |
| 3,835,354 | 9/1974 | Torres-Pena . | |
| 3,999,824 | 12/1976 | Pearson . | |
| 4,126,364 | 11/1978 | Reilly | 312/265.1 X |
| 4,148,535 | 4/1979 | Fenwick | 312/265.1 X |
| 4,566,742 | 1/1986 | Schmied | 312/257.1 |
| 4,572,593 | 2/1986 | Takamizawa et al. | 312/114 |
| 4,684,128 | 8/1987 | Verstraeten . | |
| 4,685,673 | 8/1987 | Verstraeten . | |

FOREIGN PATENT DOCUMENTS

| | | | |
|---|---|---|---|
| 2132153 | 1/1972 | Germany | 312/140 |
| 2151462 | 7/1985 | United Kingdom | 312/140 |
| 8602245 | 4/1986 | WIPO | 312/265.2 |
| 4015500 | 7/1994 | WIPO | 312/114 |

*Primary Examiner*—Peter M. Cuomo
*Assistant Examiner*—Rodney B. White
*Attorney, Agent, or Firm*—Brady, O'Boyle & Gates

[57] ABSTRACT

A skill crane cabinet having an extruded aluminum frame assembly formed with channels selectively receiving panels forming the side, back and front walls of the cabinet. The panels have various decorative appearances to blend in and compliment the decor of the particular business establishment in which the cabinet is placed.

13 Claims, 4 Drawing Sheets

SKILL CRANE CABINET

BACKGROUND OF THE INVENTION

Skill cranes have been in use for many years wherein a plurality of various prizes are contained within a cabinet having a claw mechanism contained therein, and actuated by a person outside of the cabinet, whereby an attempt is made to grasp and retrieve one of the prizes from the cabinet within a predetermined period of time.

These skill cranes are usually found at amusement parks and arcades but they can now be found in today's busy, customer-service oriented business establishments, such as restaurants; accordingly, it is desirable to eliminate the arcade appearance of the cabinet; accordingly, the cabinet of the present invention has been devised to be capable of having various appearances to blend in and compliment the decor of the particular business establishment in which it is placed.

SUMMARY OF THE INVENTION

The skill crane cabinet of the present invention comprises, essentially, an extruded aluminum frame assembly secured to a top wall and a bottom wall of heavy gauge, cold rolled, steel. The extruded aluminum frame assembly is formed with channels for selectively receiving panels of various appearances in keeping with the decor of the business establishment in which it is placed.

DESCRIPTION OF THE PREFERRED EMBODIMENT

Figure 1:
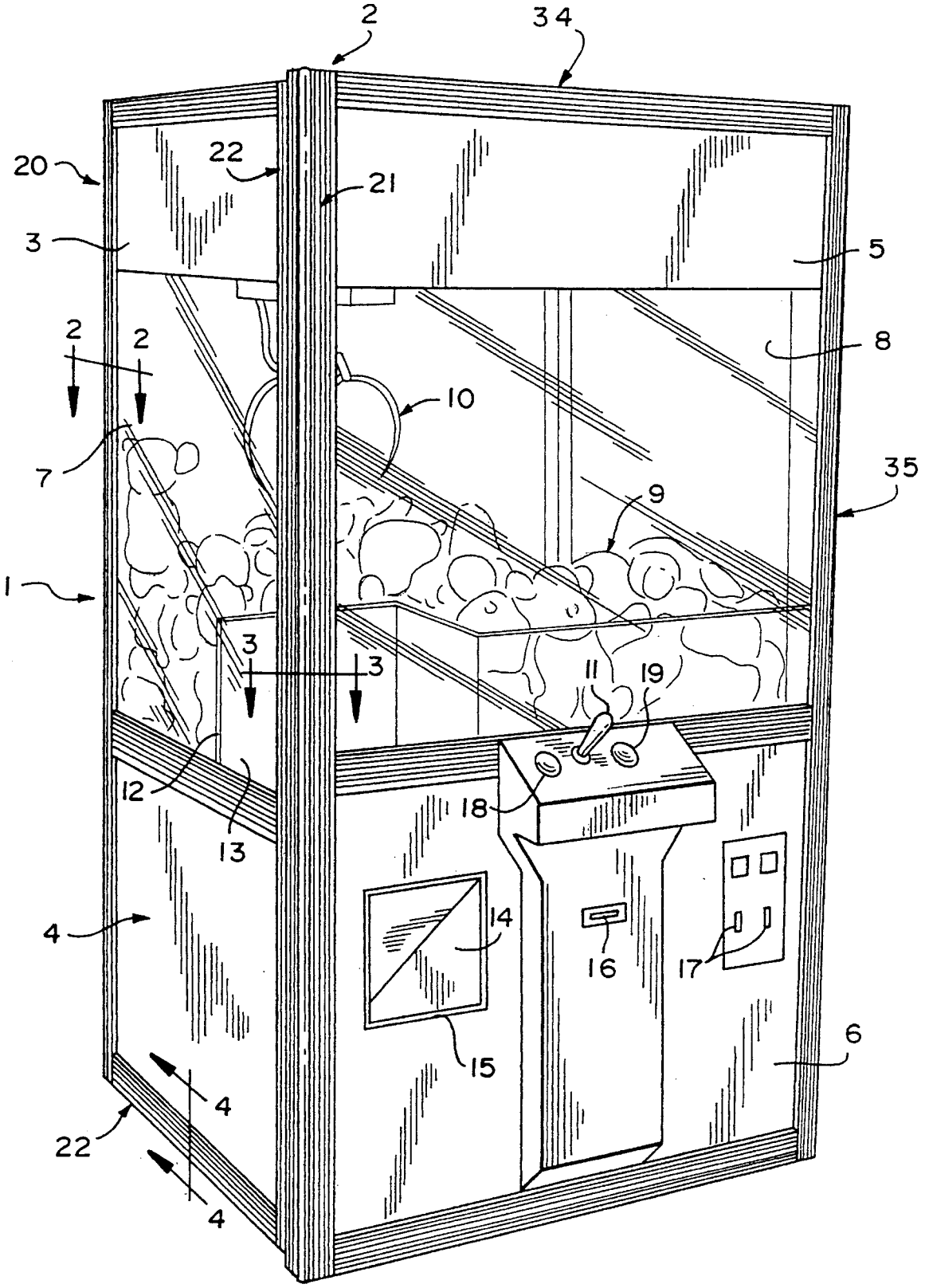
FIG. 1 is a perspective view of the skill crane cabinet of the present invention.

Referring to the drawings and more particularly to FIG. 1, the skill crane cabinet 1 of the present invention comprises, an extruded aluminum frame assembly 2 having opaque decorative panels 3, 4, 5 and 6, selectively mounted therein, together with transparent glass panels 7 and 8 to thereby provide a side and the front of the cabinet 1, it being understood that the opposite side of the cabinet is identical to the side containing panels 3, 4 and 7, and a back of the cabinet can have panels similar to the sides of the cabinet or have a single opaque panel.

The cabinet 1 contains a plurality of prizes 9, such as stuffed animals, adapted to be grasped by a claw assembly 10 operated by a person using a joystick 11 mounted on the front of the cabinet 1. A plexiglass partition 12 is mounted in the cabinet 1 to provide a chamber 13 within the cabinet communicating with a chute 14 having an opening 15 in the front of the cabinet, whereby a prize 9 grasped by the claw assembly is deposited into the chute 14 and retrieved therefrom by the person operating the machine.

The front of the machine also includes a dollar bill receiving slot 16 and coin receiving slots 17. Lights 18 and 19 are also provided adjacent the joystick 11 to advise the operator of the start and expiration of the allowed time for grasping a prize.

Figure 2:
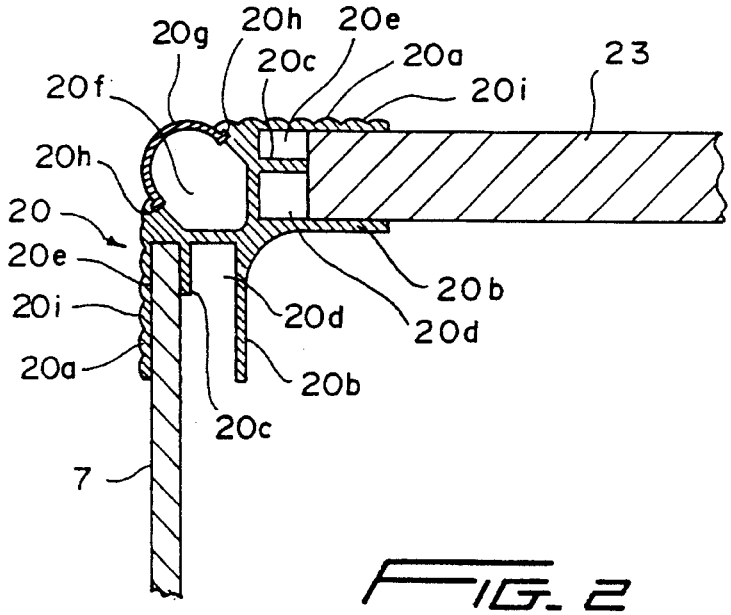
FIG. 2 is a view taken along line 2—2 of FIG. 1.
Figure 4:
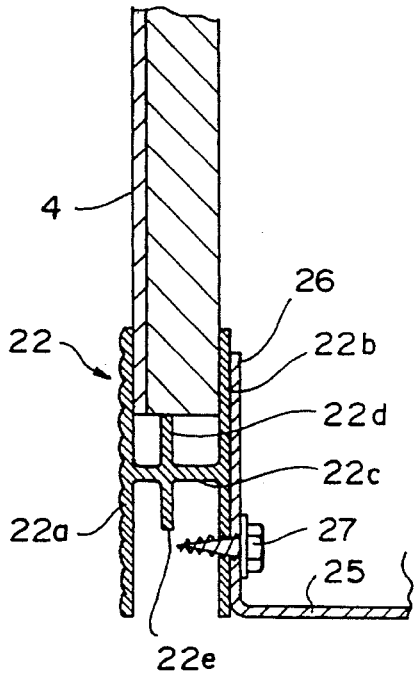
FIG. 4 is a view taken along line 4—4 of FIG. 1.
Figure 3:
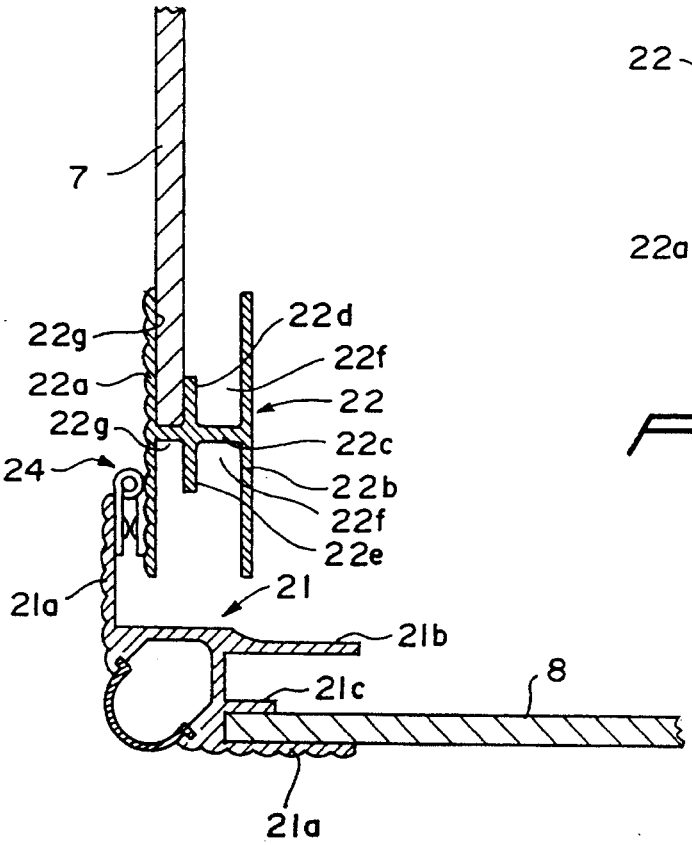
FIG. 3 is a view taken along line 3—3 of FIG. 1.

The details of the basic components of the extruded aluminum frame assembly are disclosed in FIGS. 2, 3 and 4 wherein a full corner 20 is shown in FIG. 2, a half corner 21 is shown in FIG. 3, and a straight section 22 is shown in FIGS. 3 and 4. The full corner component 20 comprises a right angle extruded member having outer leg members 20*a* extending normal to each other, and inwardly spaced inner leg members 20*b* extending normal to each other. A short flange member 20*c* is integral with the right angle extruded member and is positioned between the leg members 20*a* and 20*b* to thereby form a pair of channels 20*d* and 20*e*. The right angle extruded member is provided with an entrant portion 20*f* which is closed by a plastic decorative strip 20*g* slidably mounted in slots 20*h* provided in the side walls of the entrant portion 20*f*. The outer surface of the leg members 20*a* are similarly formed with a decorative surface 20*i* which can be scalloped or corrugated.

The half corner 21 is similar to the full corner 20 except only one inner leg 21*b* and one short flange 21*c* are provided.

The straight section 22 comprises a pair of spaced, parallel outer and inner legs 22*a* and 22*b*, respectively, having an integral, transversely extending web portion 22*c* extending therebetween. A pair of oppositely extending flange members 22*d* and 22*e* are integral with the web portion 22*c* and spaced inwardly from the legs 22*a* and 22*b* to provide channels 22*f* and 22*g*.

The full corner 20 shown in FIG. 2 extends vertically and provides the left rear corner of the cabinet 1 with the glass panel 7 inserted into the channel 20*e*. The back wall 23 of the corner is inserted into the space between the outer and inner legs 20*a* and 20*b*.

The straight member 22, shown in FIG. 3, also extends vertically and the channel 22*g* receives the glass panel 7, and a vertically extending piano type hinge 24 is fastened between the outer leg 21*a* of the half corner 21 and the outer leg 22*a* of the straight section 22, whereby the front of the cabinet provides a hinged door to provide access to the interior of the cabinet.

FIG. 4 illustrates the cabinet bottom wall 25 of heavy gauge cold rolled steel having an upturned flange 26 fastened to the inner leg 22*b* of a horizontally extending straight member 22 by means of screws 27. The decorative panel 4 is inserted in the space between the outer and inner legs 22*a* and 22*b*, the panel 4 being either a laminate structure having a ⅛" thick outer layer of plexiglass and a ⅝" thick inner layer of melamine, or a ¾ thick solid wood panel.

Figure 5:
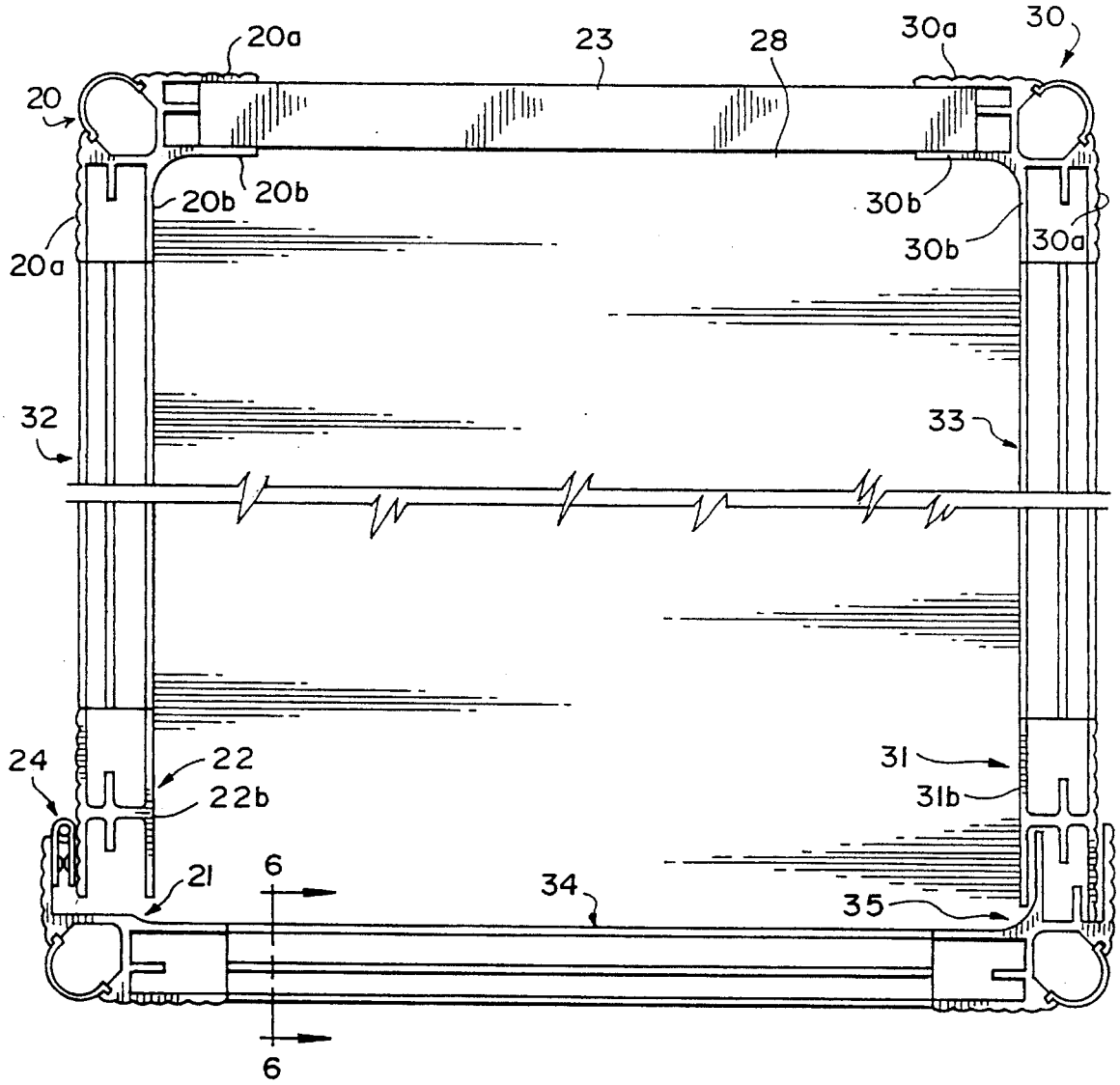
FIG. 5 is a top plan view of the cabinet.
Figure 6:
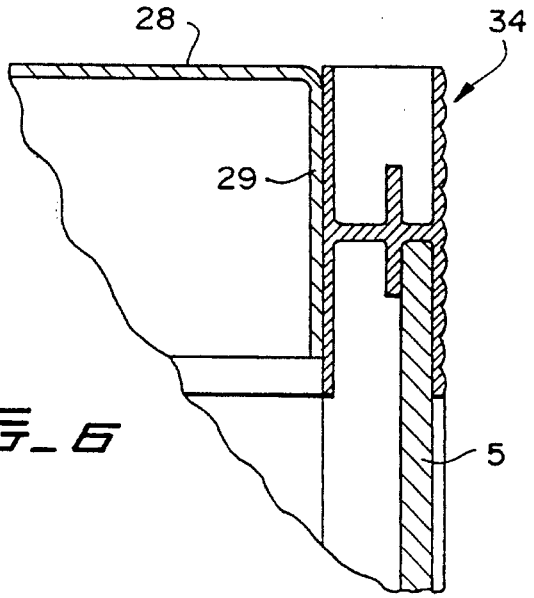
FIG. 6 is a view taken along line 6—6 of FIG. 5.

FIGS. 5 and 6 illustrate the top of the cabinet wherein a wall 28 of heavy gauge cold rolled steel having a down-turned peripheral flange 29 is fastened to the inner leg members 20*b* of the left rear full corner component 20, and the inner leg members 30*b* of the right rear full corner component 30, the fastening being accomplished by screws similar to screws 27 for securing the bottom wall 25 in place. The down-turned flange 29 of the top wall 28 is similarly fastened to the inner leg 22*b* of the straight member 22 at the front left side of the cabinet and to the inner leg 31*b* of the straight member 31 positioned at the front right side of the cabinet. Channeled trim members 32 and 33 extend between each full corner member 20 and 30 and a respective straight member 22 and 31. The front of the cabinet is also provided with a channeled trim member 34 extending between the half corner component 21 at the left front of the cabinet and a full corner component 35 at the front right side of the cabinet. It will thus be seen that the half corner component 21, trim member 34, full corner component 35 and associated panels 5, 6 and 8, FIG. 1, provide a door to the interior of the cabinet.

Figure 7:
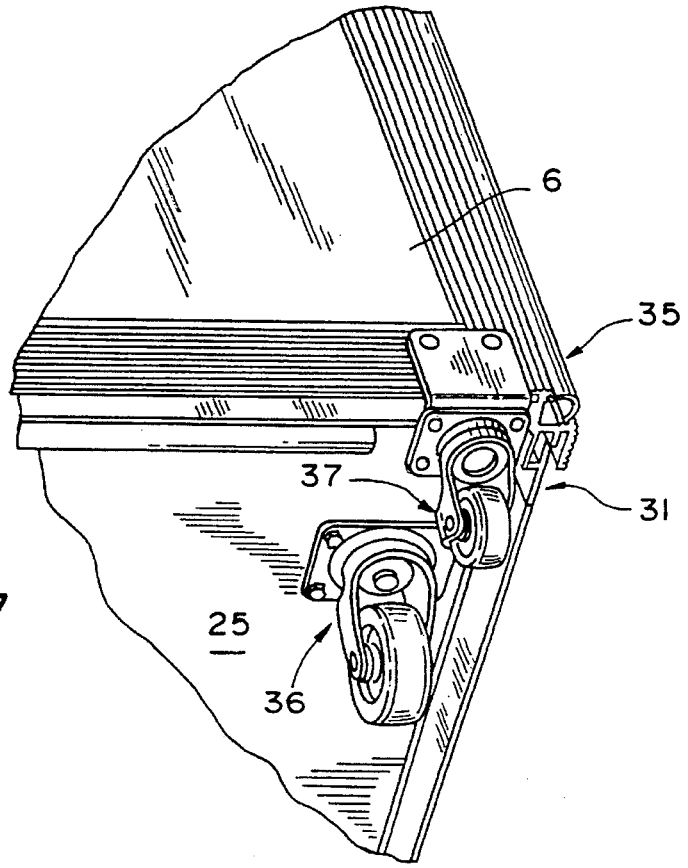
FIG. 7 is a fragmentary perspective view of the bottom of the cabinet and the lower front right corner thereof.

Referring to FIG. 7, at least four caster wheels 36 are secured to the bottom wall 25 of the cabinet to facilitate transporting the cabinet, and another caster wheel 37 is secured to the lower end of the front right full corner component 35 to facilitate the movement of the front door during the opening and closing thereof.

Figure 8:
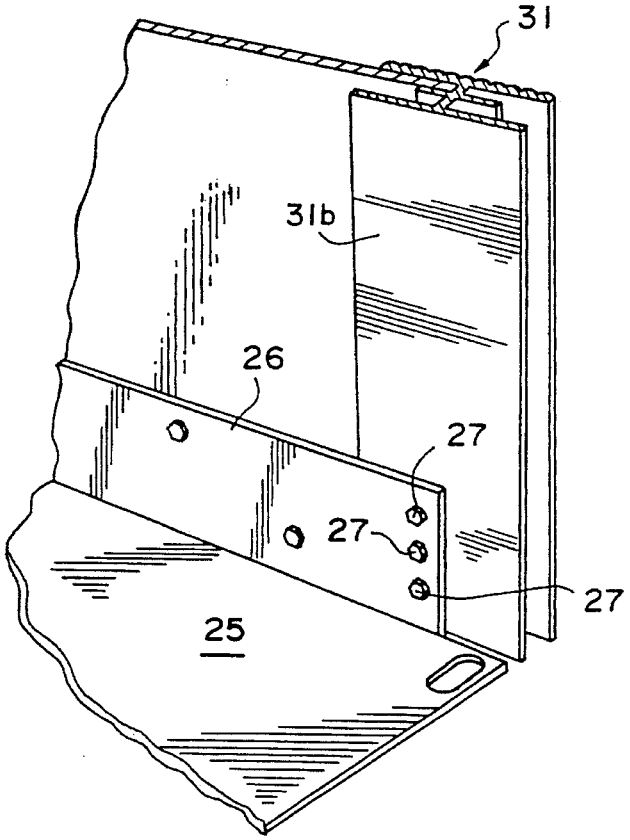
FIG. 8 is a fragmentary perspective view, partly in section, showing a portion of the bottom and the front right edge of the cabinet side wall.

FIG. 8 illustrates the bottom wall 25 being fastened to the inner leg **31*b* of straight member 31 by the screws 27 passing through the upturned flange 26. An aperture 38** is provided in the bottom wall for receiving the lower end of a lock bar.

From the above description, it will be readily apparent to those skilled in the art that the extruded aluminum frame assembly provided by the full cornered channel members 20, 30, 35, half corner channel member 24, and straight channel members 22, 31, 32 and 33, facilitate the assembling of the cabinet 1 which can selectively receive panels of various appearances in keeping with the decor of the room in which it is placed.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A cabinet comprising, a rectangular extruded aluminum frame assembly having top, bottom, and side corners, and top, side and bottom edges, side, front, back, top and bottom walls secured to said frame assembly, said top wall being secured to at least two of the extruded aluminum frame assembly top corners and at least two of the extruded aluminum top edges, the bottom wall being secured to at least two of the extruded aluminum bottom edges, and channels integral with the corners, top, side and bottom edges of the extruded aluminum frame assembly, whereby panels of various decorative appearances may be removably inserted into said channels in keeping with a decor of a room in which the cabinet is placed.

2. A cabinet according to claim 1, wherein the cabinet is a skill crane cabinet containing a plurality of various prizes, a claw mechanism contained within said cabinet adapted to be actuated for grasping and retrieving a prize within the cabinet, a control assembly mounted on the front wall of the cabinet operatively connected to the claw mechanism, and a discharge opening in the front wall of the cabinet for receiving a prize from the claw mechanism.

3. A cabinet according to claim 1, wherein at least three corners of the extruded aluminum frame assembly have a full corner extruded aluminum member, each full corner comprising, a right angle member having a pair of outer leg members having outer surfaces extending normal to each other, a pair of inner leg members spaced inwardly from the outer leg members extending normal to each other, and a short flange member integral with the right angle member and positioned between and spaced from the inner and outer leg members to thereby provide a plurality of channels for receiving said panels.

4. A cabinet according to claim 3, wherein an entrant portion is provided in the full corner member, and a decorative strip slidably mounted on the full corner member closing said entrant portion.

5. A cabinet according to claim 4, wherein the outer surfaces of the outer leg members of said full corner member are formed with a decorative surface.

6. A cabinet according to claim 1, wherein one of the side corners of the extruded aluminum frame assembly has a half corner extruded aluminum member, said half corner member comprises, a right angle member having a pair of outer leg members having outer surfaces extending normal to each other, an inner leg member spaced inwardly from one of said outer leg members and extending parallel thereto, a short flange member integral with the right angle member and positioned between and spaced from the inner and outer leg members to thereby provide a pair of channels for receiving the panels.

7. A cabinet according to claim 6, wherein a hinge is connected between one of the outer leg members of said half corner member and a side edge of the frame assembly, to thereby provide a door for the cabinet.

8. A cabinet according to claim 7, wherein a caster wheel is mounted on the bottom edge of said door to facilitate the opening and closing thereof.

9. A cabinet according to claim 6, wherein an entrant portion is provided in the half corner member, and a decorative strip slidably mounted on the half corner member closing said entrant portion.

10. A cabinet according to claim 9, wherein the outer surface of each outer leg is formed with a decorative surface.

11. A cabinet according to claim 1, wherein the top, bottom edges of the extruded aluminum frame assembly have straight extruded aluminum members, each straight member comprising, a pair of spaced, parallel outer and inner legs, said outer legs having an outer surface an integral transversely extending web portion extending between said legs, and a pair of oppositely extending flange members integral with the web portion and spaced inwardly from the inner and outer legs, to thereby provide channels for said panels.

12. A cabinet according to claim 11, wherein a decorative surface is formed on the outer surface of each outer leg.

13. A cabinet according to claim 1, wherein caster wheels are secured to the bottom wall of the cabinet to facilitate transporting the cabinet.

* * * * *